US009016683B2

(12) United States Patent
Sonnenberg

(10) Patent No.: US 9,016,683 B2
(45) Date of Patent: Apr. 28, 2015

(54) MEDIA ITEM TRANSPORTATION

(71) Applicant: NCR Corporation, Duluth, GA (US)

(72) Inventor: Matthew Sonnenberg, Kitchener, CA (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/954,556

(22) Filed: Jul. 30, 2013

(65) Prior Publication Data

US 2015/0035219 A1 Feb. 5, 2015

(51) Int. Cl.

| | |
|---|---|
| ***B65H 29/54*** | (2006.01) |
| ***B65H 5/26*** | (2006.01) |
| ***B65H 5/06*** | (2006.01) |
| ***B65H 29/58*** | (2006.01) |

(52) U.S. Cl.

CPC .. *B65H 5/26* (2013.01); *B65H 5/06* (2013.01); *B65H 29/58* (2013.01); *B65H 2404/2615* (2013.01)

(58) Field of Classification Search

USPC ..... 271/3.18, 3.19, 3.2, 3.24, 267, 268, 271/270, 301, 302, 198, 200, 202, 203

See application file for complete search history.

(56) References Cited

U.S. PATENT DOCUMENTS

| | | | | |
|---|---|---|---|---|
| 4,424,966 | A * | 1/1984 | Chandhoke | 271/302 |
| 4,426,074 | A * | 1/1984 | Fischer | 271/302 |
| 5,054,763 | A * | 10/1991 | Achelpohl et al. | 271/182 |
| 5,141,219 | A * | 8/1992 | Watts et al. | 271/203 |
| 5,158,278 | A * | 10/1992 | Auf der Mauer | 271/270 |
| 6,443,448 | B1 * | 9/2002 | Mohr et al. | 271/270 |
| 7,597,325 | B2 * | 10/2009 | Maierhofer et al. | 271/302 |

* cited by examiner

*Primary Examiner* — Ernesto Suarez

(74) *Attorney, Agent, or Firm* — Joseph P. Mehrle

(57) ABSTRACT

The present invention provides a method and apparatus for transporting media items along a transport path. The apparatus comprises a first transport member and a further transport member that selectively apply an urging force to at least one media item to urge said media item along a transport path, wherein in a first mode of operation, the urging force is applied to said media item to transport said media item at least partially along the transport path and, in a further mode of operation, the urging force on said media item is released to allow at least one end region of the media item to move freely along the transport path.

6 Claims, 6 Drawing Sheets

MEDIA ITEM TRANSPORTATION

FIELD OF THE INVENTION

The present invention relates to a method and apparatus for transporting items of media along a transport path. In particular, but not exclusively, the present invention relates to preventing at least one media item from becoming damaged whilst it is being transported along a changeable transport path.

Various situations are known in which items of media are transported along different transport pathways in a Self-Service Terminal (SST). For example, in a typical check depositing Automated Teller Machine (ATM), an ATM customer is allowed to deposit a check (without having to place the check in a deposit envelope) in a publicly accessible, unattended environment. To deposit a check, the ATM customer inserts an identification card through a card slot at the ATM, enters the amount of the check to be deposited and inserts the check to be deposited through a check slot of a check acceptor. A check transport mechanism receives the inserted check and transports the check in a forward direction along an "infeed" check transport path to a number of locations within the ATM to process the check.

If the check is not accepted for deposit, the check transport mechanism transports the check in a reverse direction along a "return" check transport path to return the check to the ATM customer via the check slot.

If the check is accepted for deposit, an amount associated with the check is deposited into the ATM customer's account and the check itself is transported to a storage bin within the ATM. An endorser printer prints an endorsement onto the check as the check is being transported and stored in a storage bin.

Checks in the storage bin within the ATM are periodically picked up and physically transported via courier to a back office facility of a financial institution for further processing.

It is known for a check transport mechanism to include a first transport member and a second transport member for transporting checks along the infeed or return transport path. Each transport member includes a transport belt for urging checks along the desired transport path. The belts have a relatively high coefficient of friction as they must effectively grip the checks to move them. It is also known for the infeed transport path to be differently oriented with respect to the return transport path so the second transport member is selectively movable relative to the first transport member to move between infeed and return positions to respectively direct one or more checks along the infeed or return transport path as desired. A gap between respective ends of the first and second transport members changes as the second transport member moves with respect to the first transport member between the infeed and return positions.

One or more problems therefore exist relating to how to transport media items from the first transport member to the second transport member, or vice versa, over this gap which may have a variable length and orientation. Such problems also relate to how media items are transported along the infeed or return transport path to prevent an error occurring during a customer transaction at the ATM and/or to prevent one or more media items being damaged during a transaction. For example, a media item can be crumpled or creased when the second transport member is moved from the return position to the infeed position and a media item can be stretched when the second transport member is moved from the infeed position to the return position.

SUMMARY OF THE INVENTION

It is an aim of the present invention to at least partly mitigate the above-mentioned problems.

It is an aim of certain embodiments of the present invention to provide a method and apparatus for transporting media items along a predetermined transport path within an SST.

It is an aim of certain embodiments of the present invention to provide a method and apparatus for transporting media items along a predetermined transport path whilst preventing the media items from becoming damaged when the transport path is selectively reoriented during use.

It is an aim of certain embodiments of the present invention to provide a method and apparatus for preventing media items from becoming damaged when a second transport member of a media item processing module is reoriented with respect to a first transport member of the media item processing module to selectively reorient the transport path.

According to a first aspect of the present invention there is provided a method of transporting at least one media item along a transport path, comprising:

in a first mode of operation, applying an urging force to at least one media item to transport said media item at least partially along a transport path; and in a further mode of operation, releasing the urging force on said media item to allow at least one end region of the media item to move freely along the transport path.

Aptly, the method further comprises:

in the first mode of operation, coupling at least one drive member to a first belt of a first transport member and to a further belt of a further transport member to urge the at least one media item along the transport path when the first and further belts are rotated by said drive member; and in the further mode of operation, when said media item extends between the first and further belts, decoupling said drive member from the first and/or further belt whereby the first and/or further belt is free to rotate to allow the at least one end region of the media item to move freely along the transport path.

Aptly, the decoupling step further comprises:

automatically decoupling said drive member from the first and/or further belt responsive to a one of the first and further transport members moving with respect to a remainder one of the first and further transport members thereby preventing damage to a media item.

Aptly, the decoupling step further comprises:

moving the first transport member with respect to the further transport member between a first position and a further position about an axis substantially perpendicular to the at least one transport path, wherein a first end region of the first transport member is pivotally connected about the axis to a further end region of the further transport member.

Aptly, the at least one drive member comprises at least one drive gear, and the decoupling step comprises:

responsive to the first transport member moving from the first position to the further position, moving the at least one drive gear from a first engaged position in which the at least one drive gear is engaged with at least one first driven gear coupled to the first and further belts, to a further engaged position in which the at least one drive gear is engaged with at least one further driven gear coupled to the first and further belts, and decoupling the at least one drive gear from the first and further belts when the drive gear moves between the first engaged position and the further engaged position.

Aptly, the method further comprises:

via the first and further belts, urging the at least one media item in a first direction along the transport path when the first transport member is in the first position, and urging the media item in a further direction along the transport path when the first transport member is in the further position, said first direction being opposite to said further direction.

According to a second aspect of the present invention there is provided apparatus for transporting at least one media item along a transport path, comprising:

a first transport member and a further transport member that selectively apply an urging force to at least one media item to urge said media item along a transport path; wherein in a first mode of operation, the urging force is applied to said media item to transport said media item at least partially along the transport path and, in a further mode of operation, the urging force on said media item is released to allow at least one end region of the media item to move freely along the transport path.

Aptly, the apparatus further comprises:

a first belt of the first transport member and a further belt of the further transport member that are selectively driven by at least one drive member, and in the first mode of operation, the at least one drive member is selectively coupled to the first and further belts to rotate the first and further belts and urge the at least one media item along the transport path and, in the further mode of operation, when said media item extends between the first and further belts, said drive member is decoupled from the first and/or further belts whereby the first and/or further belt is free to rotate to allow the at least one end region of the media item to move freely along the transport path.

Aptly, the at least one drive member is automatically decoupled from the first and/or further belts responsive to a one of the first and further transport members moving with respect to a remainder one of the first and further transport members thereby preventing damage to a media item.

Aptly, a first end region of the first transport member is pivotally connected to a further end region of the further transport member about an axis substantially perpendicular to the transport path, and the at least one drive member is decoupled from the first and/or further belt when the first transport member moves with respect to the further transport member about the axis between a first position and a further position.

Aptly, the at least one drive member comprises at least one drive gear which, when the first transport member is in the first position, engages with at least one first driven gear coupled to the first and further belts and, when the first transport member is in the further position, engages with at least one further driven gear coupled to the first and further belts.

Aptly, the first and further belts urge the at least one media item in a first direction along the transport path when the first transport member is in the first position and urge the media item in a further direction along the transport path when the first transport member is in the further position, said first direction being opposite to said further direction.

Aptly, the apparatus further comprises:

a clutch member located between the at least one drive member and the first and further belts that selectively decouples the at least one drive member from the first and/or further belt responsive to the first transport member moving with respect to the further transport member.

According to a third aspect of the present invention there is provided a media item processing module comprising apparatus in accordance with the second aspect of the present invention.

According to a fourth aspect of the present invention there is provided a Self-Service Terminal (SST) comprising a media item processing module in accordance with the third aspect of the present invention.

According to a fifth aspect of the present invention there is provided a method of transporting at least one media item along at least one transport path, comprising:

in a first mode of operation, constraining at least one media item being urged at least partially along a transport path; and in a further mode of operation, releasing at least an end region of said media item to allow said end region to move freely.

Certain embodiments of the present invention provide a method and apparatus for transporting media items along a changeable transport path within an SST.

Certain embodiments of the present invention provide a method and apparatus for transporting media items along a predetermined transport path from a first transport member and a second transport member, and vice versa, whilst preventing the media items from becoming damaged when the transport path is selectively changed during use.

Certain embodiments of the present invention provide a method and apparatus for preventing media items from becoming damaged when a second transport member of a media item processing module is reoriented with respect to a first transport member of the media item processing module to selectively reorient the transport path from an infeed transport path to a return transport path, and vice versa.

Certain embodiments of the present invention prevent a media item from becoming crumpled or stretched when the media item is located across first and second transport members of a media item processing module and the when the second transport member is rotated with respect to the first transport member to reorient a transport path extending from the first transport member to the second transport member, and vice versa.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
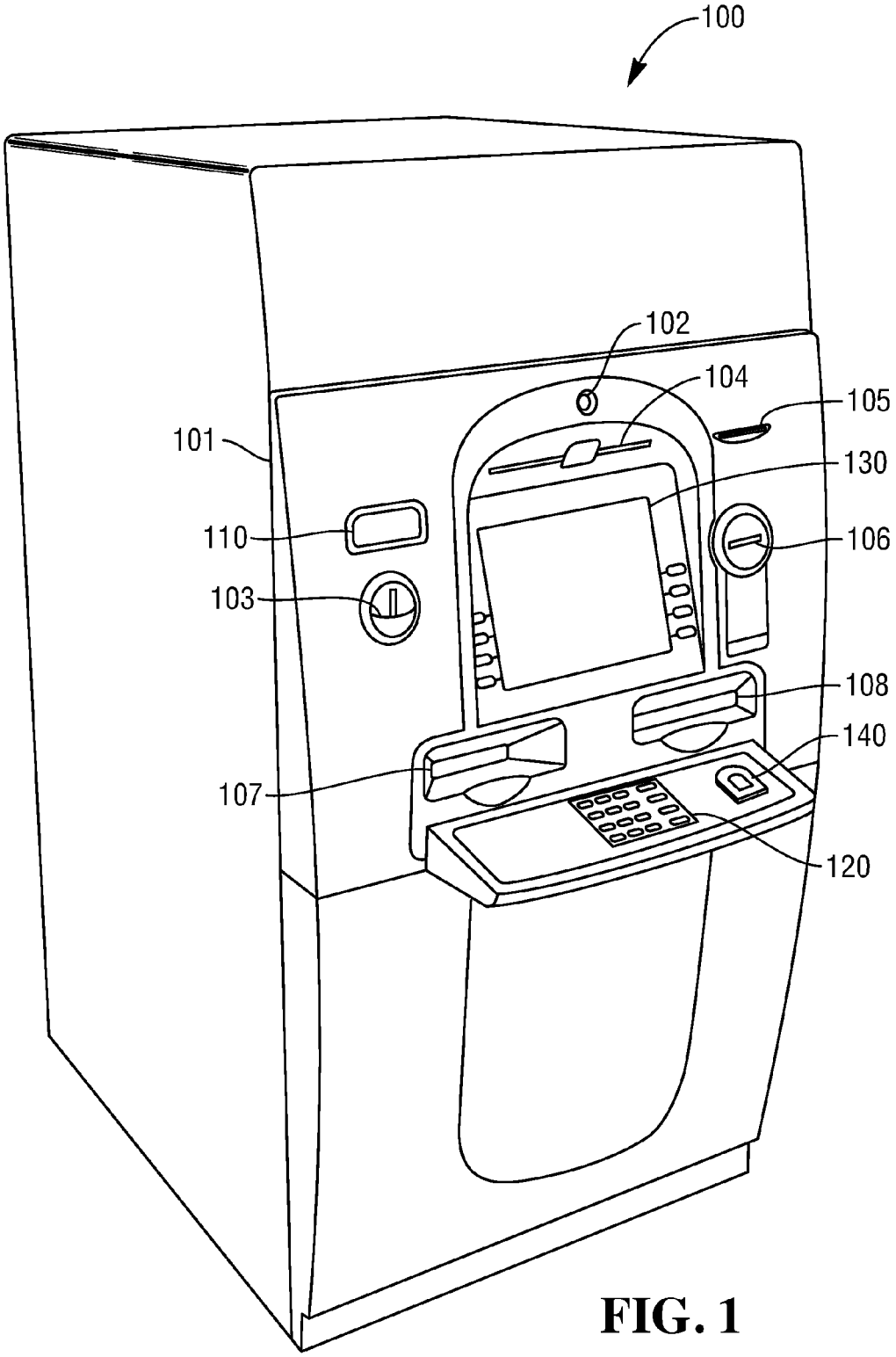
FIG. 1 illustrates an ATM according to an embodiment of the present invention.

In the drawings like reference numerals refer to like parts.

FIG. 1 illustrates a self-service check depositing terminal in the form of an image-based check depositing Automated Teller Machine (ATM) 100. It will be appreciated that certain embodiments of the present invention are applicable to a wide variety of terminals in which items of media such as checks and/or currency notes and/or giros and/or lottery tickets and/or other such flexible sheet-like items of media are to be transported and directed in different directions. The type of terminal will of course be appropriate for the type of items of media being transported.

As illustrated in FIG. 1, the ATM 100 includes a fascia 101 coupled to a chassis (not shown). The fascia 101 defines an aperture 102 through which a camera (not shown) images a customer of the ATM 100. The fascia 101 also defines a number of slots for receiving and dispensing media items and a tray 103 into which coins can be dispensed. The slots include a statement output slot 104, a receipt slot 105, a card reader slot 106, a cash slot 107, a further cash slot 108 and a check input/output slot 110. The slots and tray are arranged such that the slots and tray align with corresponding ATM modules mounted within the chassis of the ATM.

The fascia 101 provides a customer interface for allowing an ATM customer to execute a transaction. The fascia 101 includes an encrypting keyboard 120 for allowing an ATM customer to enter transaction details. A display 130 is provided for presenting screens to an ATM customer. A fingerprint reader 140 is provided for reading a fingerprint of an ATM customer to identify the ATM customer.

Within the chassis of the ATM it will be understood that items of media must be transported from time to time from one location to another. The pathway taken by any particular item of media is dependent upon an operation being carried out at the ATM and may also be dependent upon other factors such as whether a customer of the ATM is authorized and/or whether an item of media being transported satisfies certain pre-determined criteria.

Figure 2:
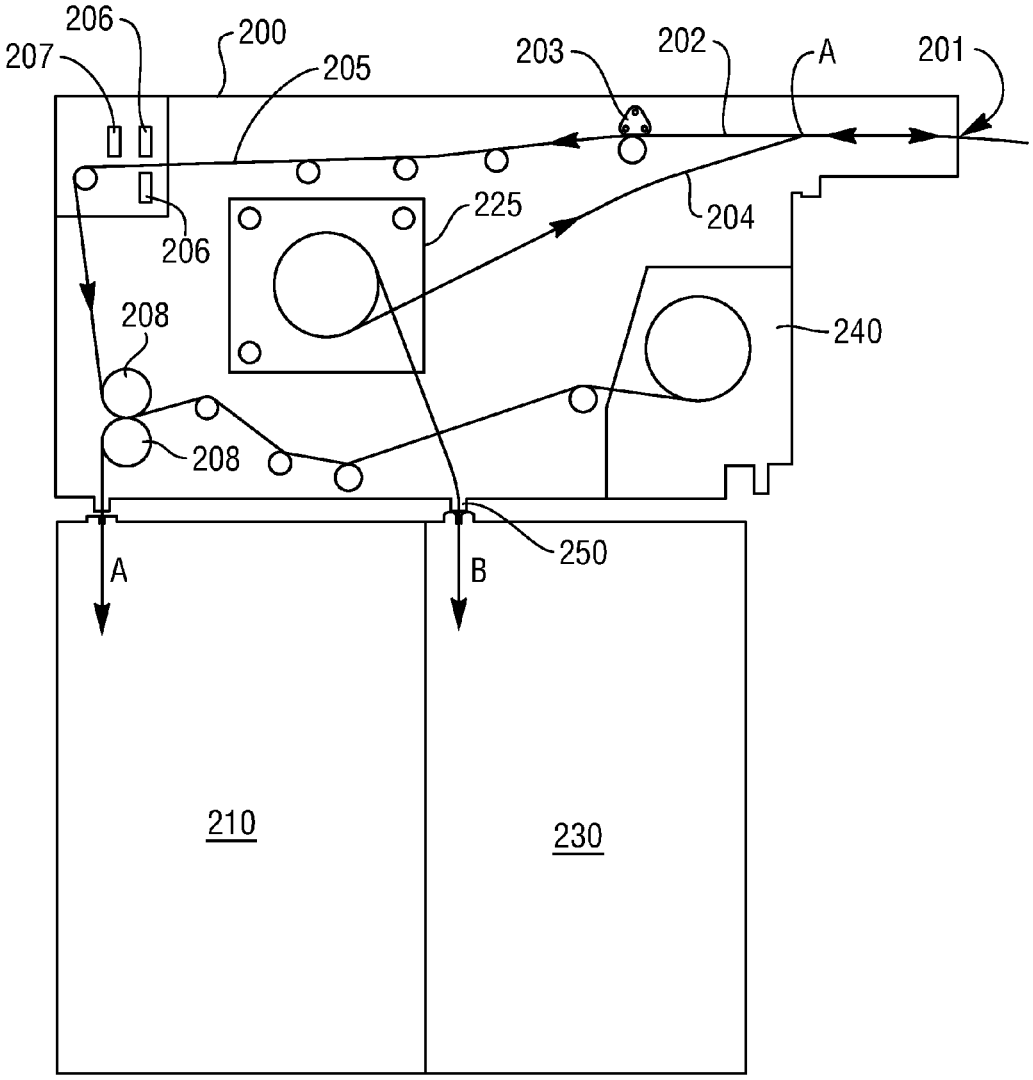
FIG. 2 illustrates transport pathways and modules within the ATM of FIG. 1 according to an embodiment of the present invention.

FIG. 2 illustrates possible transport pathways and internal modules within the ATM which can be utilized to process deposited checks. A check processing module 200 has an access mouth 201 through which incoming checks and/or currency notes are deposited or outgoing checks are dispensed. This mouth 201 is aligned with an infeed aperture in the ATM which thus provides an input/output slot 110. A bunch of one or more media items, such as currency notes or checks, is input or output. Aptly, a bunch of up to a hundred items can be received/dispensed. Aptly, a bunch of up to around a hundred items can be received/dispensed. Incoming checks follow a first transport path 202 away from the mouth 201 in a substantially horizontal direction from right to left shown in FIG. 2. The first transport path 202 is also referred to as the infeed path. The checks then pass through a feeder/separator 203 and along another pathway portion 205 which is also substantially horizontal and right to left. The checks are then de-skewed and read by imaging cameras 206 and an MICR reader 207. Checks are then directed substantially vertically downwards to a point between two nip rollers 208. These nip rollers co-operate and are rotated in opposite directions with respect to each other to either draw deposited checks inwards (and urge those checks towards the right hand side in FIG. 2), or during another mode of operation, the rollers can be rotated in an opposite fashion to direct processed checks downwards in the direction shown by arrow A in FIG. 2 into a check bin 210. Incoming checks which are moved by the nip rollers 208 towards the right can either be diverted upwards (in FIG. 2) into a re-buncher unit 225, or downwards in the direction of arrow B in FIG. 2 into a cash bin 230, or to the right hand side shown in FIG. 2 into an escrow 240. Checks from the escrow can be directed to the re-buncher 225 or downwards into the cash bin 230. Checks can be reprocessed or returned to a customer via a further transport path 204, also known as the return path.

Figure 3:
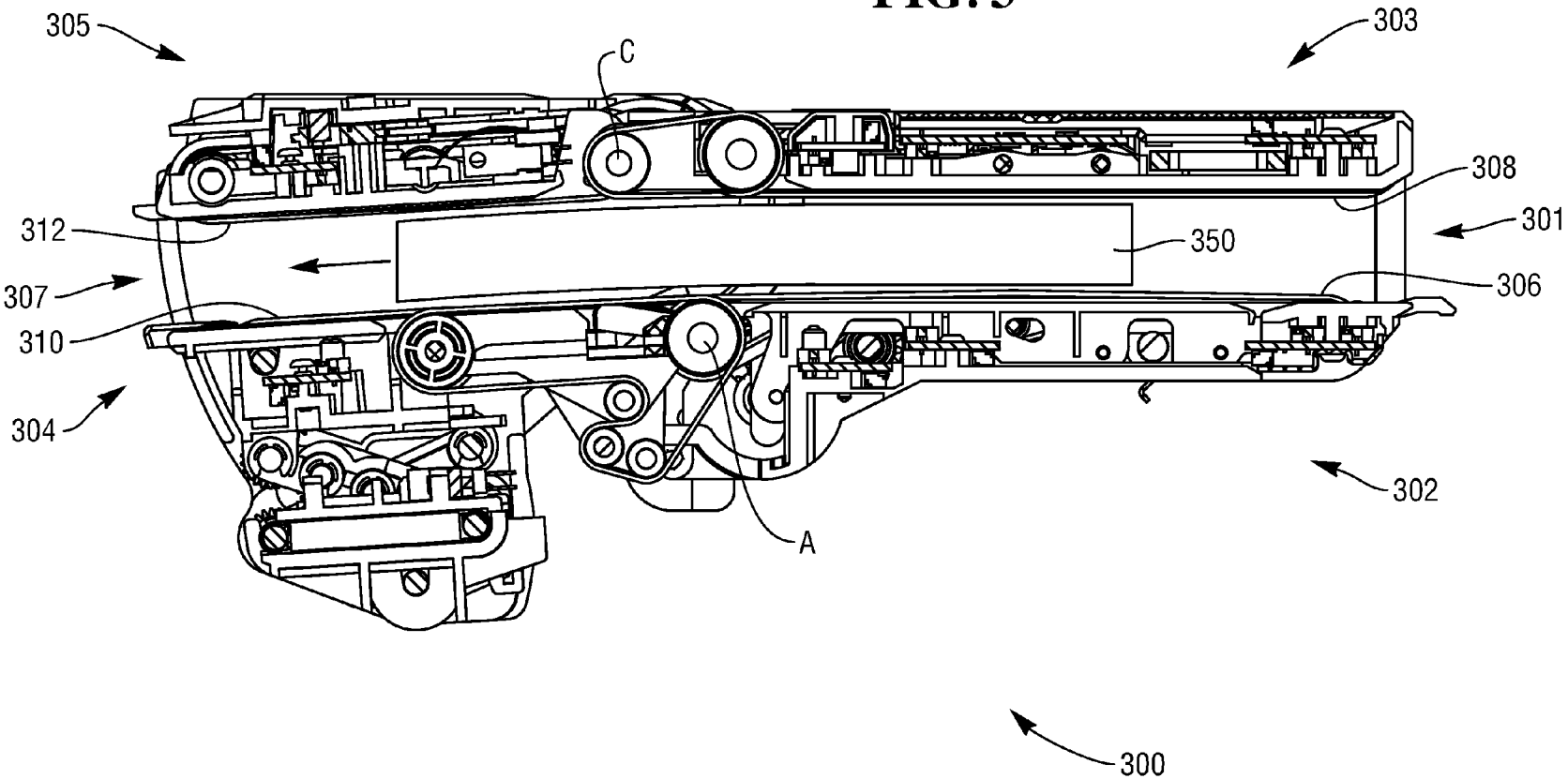
FIG. 3 illustrates a media item transport mechanism according to an embodiment of the present invention wherein the transport mechanism is in an infeed position for transporting a bunch of media items along an infeed transport path.

As illustrated in FIG. 3, a media item transport mechanism 300 includes a first pair of opposed transport members 302, 303 shown on the right-hand side of FIG. 3 and a second pair of opposed transport members 304, 305 shown on the left-hand side of FIG. 3. The pairs of transport members provide a predetermined transport path 202, 204 for a bunch of media items 350, such as checks or currency notes, to be urged along by the transport mechanism 300. An infeed end region 301 of the first pair of transport members 302, 303 is located and aligned with the access mouth 201 of the check processing module 200. The second pair of transport members 304, 305 pivots relative to the first pair of transport members 302, 305 generally about axis A to selectively direct media items along the infeed path 202 or return path 204 as desired. An end region 307 of the second pair of transport members 304, 305 is aligned with the feeder/separator 203 when in the infeed position for transporting media items along the infeed path 202.

Each of the transport members 302, 303, 304, 305 includes at least one respective transport belt 306, 308, 310, 312 for urging the bunch of media items 350 along the transport path 202, 204. Aptly, each transport member may include a pair of spaced apart transport belts. Alternatively or additionally, rollers, gears, wheels, plates, or the like, may be used to urge the bunch along the transport path 202, 204. Each pair of transport members 302, 303 and 304, 305 are selectively moved towards or away from each other between closed and open configurations. This is achieved by moving one transport member towards or away from a fixed respective transport member or by moving both respective transport members towards or away from each other. A distance between a respective pair of belts of a respective transport member when in the open configuration is determined by the thickness of a bunch of media items to be or being transported through the transport mechanism 300 and along the transport path 202, 204. For example, respective belts of a pair of transport members will be closer together when gripping and transporting a single media item and spaced further apart from each other when gripping and transporting a bunch of media items.

The lower transport member 304 of the second pair of transport members 304, 305 as shown in FIG. 3 is rotatable about axis A with respect to the lower transport member 302 of the first pair of transport members 302, 303. The upper transport member 305 of the second pair of transport members 304, 305 rotates generally about axis C with respect to the upper transport member 303 of the first pair of transport members 302, 303. Axes A and C are located at respective end regions of the upper and lower transport members 302, 303 of the first pair of transport members 302, 303. Thus, the lower transport member 304 of the second pair of transport members 304, 305 is rotatable with respect to the lower transport member 302 of the first pair of transport members 302, 303 between an infeed position, wherein media items are moved from right to left through the transport mechanism 300 and along the infeed transport path 202 to be processed in the ATM, and a return position, wherein media items are moved from left to right through the transport mechanism 300 and along the return transport path 204 to be reprocessed along the infeed path or returned to a customer.

As illustrated in FIG. 3, the first and second pairs of transport members are in a feed configuration wherein the second pair of transport members 304, 305 is orientated substantially in line and parallel with respect to the first pair of transport members 302, 303 to urge a bunch of media items 350 along the infeed transport path from right to left and into the media item processing module 200 for processing.

Figure 4:
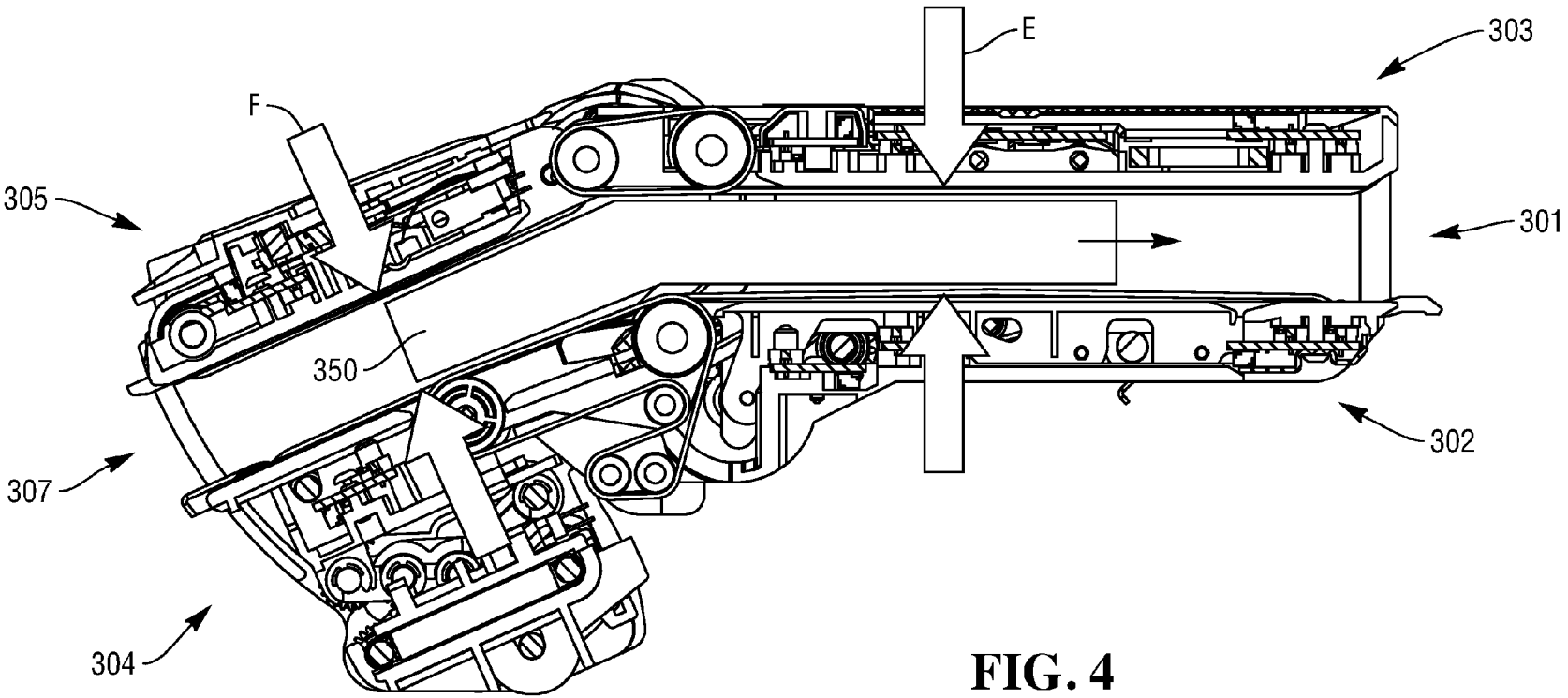
FIG. 4 illustrates the transport mechanism of FIG. 3 in a return position for transporting a bunch of media items along a return transport path.

As illustrated in FIG. 4, the first and second pairs of transport members are in a return configuration wherein the second pair of transport members 304, 305 is orientated downwardly with respect to the first pair of transport members 302, 303 to urge a bunch of media items 350 along the return transport path from left to right and towards the mouth of the media item processing module 200. To sufficiently grip and urge the bunch of media items 350 along the return path, the first pair of transport members 302, 303 apply a clamping force (indicated by arrows E) to a first end region of the bunch 350 and the second pair of transport members 304, 305 apply a clamping force (indicated by arrows F) to a second end region of the bunch 350. Similar clamping forces are applied to the bunch 350 when being transported along the infeed transport path 202.

Figure 5:
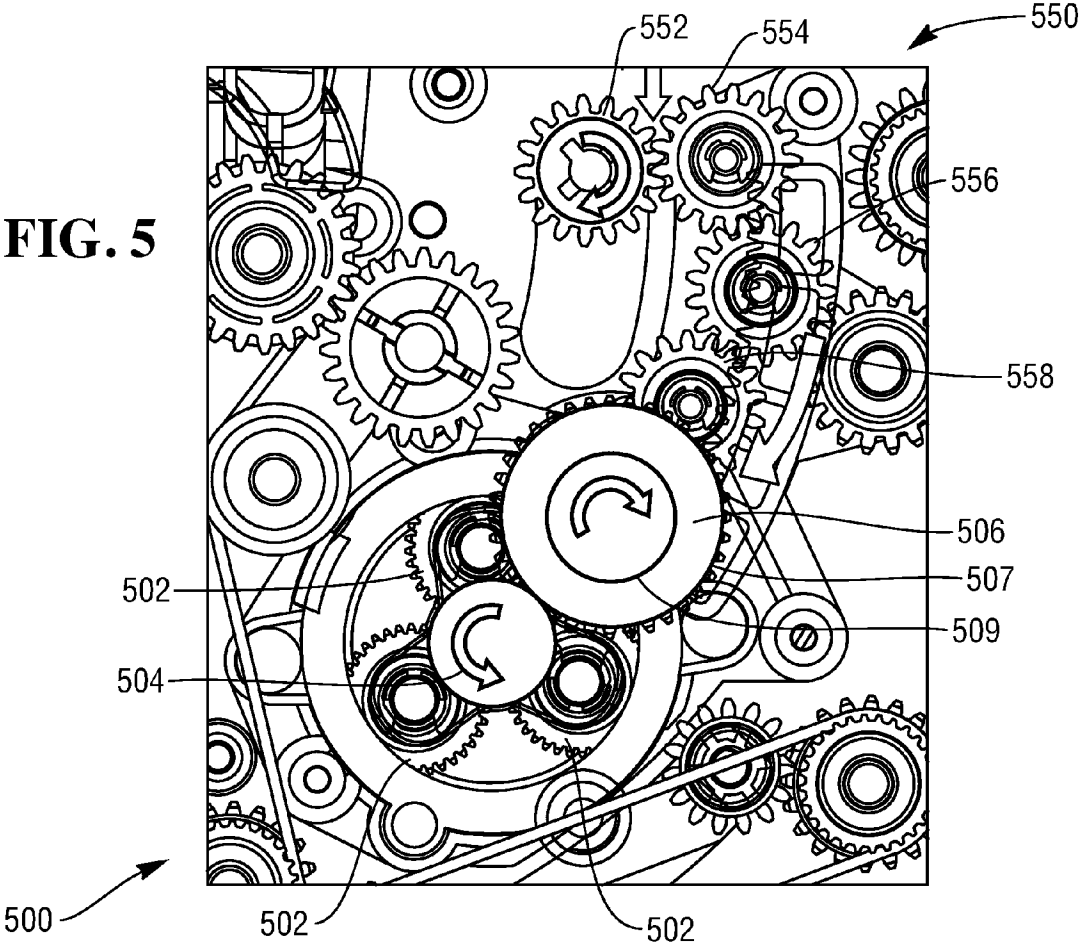
FIG. 5 illustrates a drive mechanism for driving the first and further transport members of the transport mechanism of FIGS. 3 and 4 and an orientating mechanism for moving the second transport member between the infeed and return positions.

As shown in FIG. 5, an orientation mechanism 500 includes a stepper motor (not shown) coupled to a set of planetary gears 502 which in turn drive a primary drive gear 504. The primary drive gear 504 engages with a large toothed portion 507 of a driven gear 506. Such an arrangement results in a gear reduction from the motor to the large toothed portion 507 of the driven gear 506. A small toothed portion 509 of the driven gear 506 engages with a gear segment (not shown) of the second pair of transport members 304, 305 such that the stepper motor selectively rotates the second pair of transport members 304, 305 with respect to the first pair of transport members 302, 303 between the infeed and return positions. For example, the second pair of transport members 304, 305 is rotated downwardly when the driven gear 506 is rotated in a clockwise direction and is rotated upwardly when the driven gear 506 is rotated in an anticlockwise direction.

As described, the orientation mechanism 500 selectively moves the second pair of transport members 304, 305 with respect to the first pair of transport members 302, 303 between the infeed and return positions. The gear reduction provided by the orientation mechanism 500 is such that the holding torque of the stepper motor is sufficient to hold the second pair of transport members 304, 305 in or between the infeed or return positions during drive directional changes of the transport belts 306, 308, 310, 312 of the respective pairs of transport members 302, 303, 304, 305 or during maintenance/service operations.

An upper transport belt drive mechanism 550 includes an upper drive gear 556 which is coupled via a first or second intermediate gear 554, 558 to an upper transfer gear 552. The upper transfer gear 552 is coupled to the upper transport belts 308, 312 of the respective upper transport members 303, 305 of the first and second pairs of transport members 302, 303 and 304, 305. The upper drive gear 556 is selectively rotated in a clockwise direction or anticlockwise direction by a stepper motor (not shown) dependent on the desired direction of travel of the transport belts 308, 312 to transport media items along the infeed or return paths or to clear a media item jam for example. The stepper motor is coupled to the upper drive gear 556 by an electromagnetic clutch mechanism.

In a similar manner, a lower transport belt drive mechanism (not shown) drives the lower belts 306, 310 of the respective lower transport members 303, 305 of the first and second pairs of transport members 302, 303 and 304, 305. The lower transport belt drive mechanism also includes a moveable lower transfer gear and intermediate gears. The intermediate gears may be selectively driven by a lower drive gear, in a similar manner to the upper drive mechanism, or the intermediate gears may be coupled by a belt and one of the intermediate gears may be driven, for example.

Figure 6:
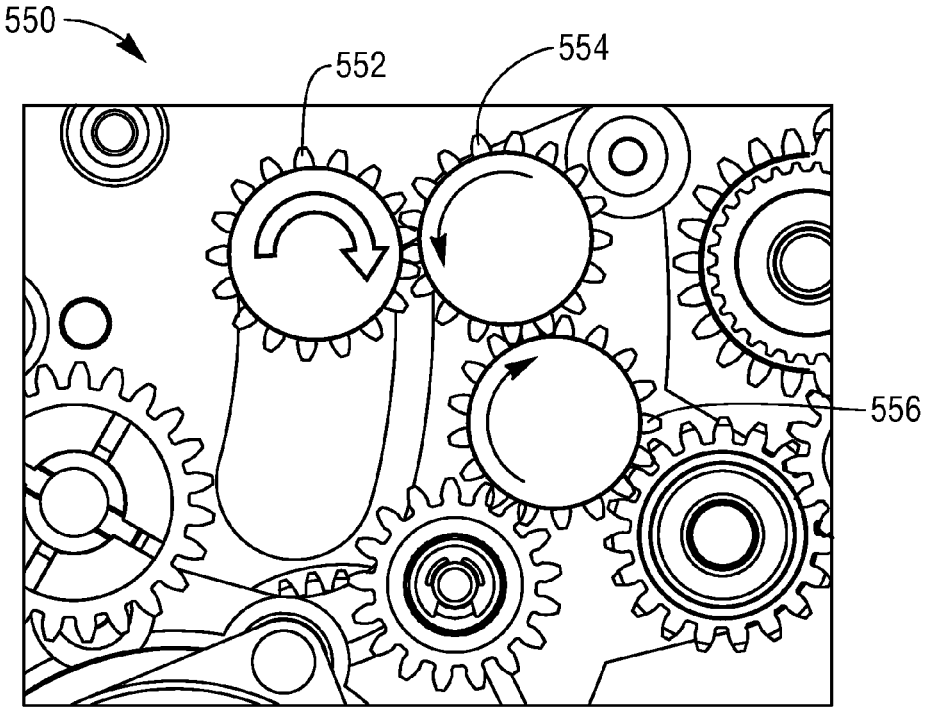
FIG. 6 illustrates a drive transfer gear of the drive mechanism of FIG. 5 in an upper engaged position.

As shown in FIG. 6, the upper transfer gear 552 is in an upper engaged position when the second pair of transport members 303, 305 is in the infeed position and the media item transport mechanism is in the infeed configuration (as shown in FIG. 3). When the upper transfer gear 552 is in the upper engaged position it is driven by the upper drive gear 556 in a clockwise direction via the first intermediate gear 554 to thereby rotate the upper transport belts 308, 312 in a clockwise direction to transport a bunch of media items 350 along the infeed transport path 202 from right to left as shown in FIG. 3.

Figure 7:
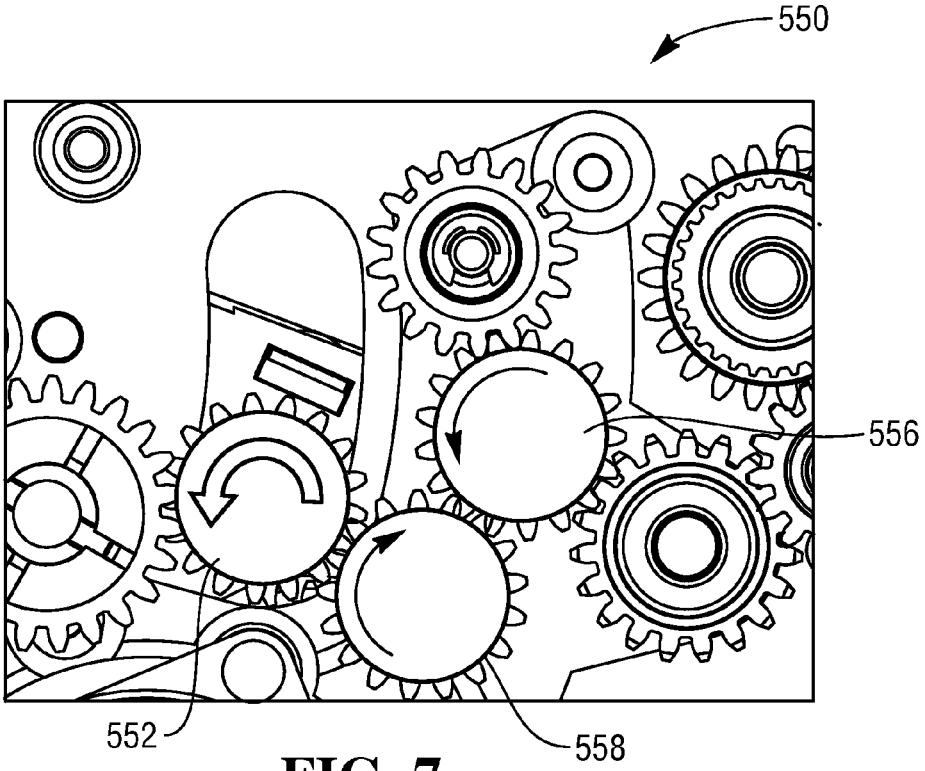
FIG. 7 illustrates the drive transfer gear of FIG. 6 in a lower engaged position.

When the second pair of transport members 304, 305 move from the infeed position to the return position to place the transport mechanism 300 in the return configuration, the upper transfer gear 552 moves from the upper engaged position to the lower engaged position, as shown in FIG. 7. When in the lower engaged position, the upper transfer gear 552 engages with a second intermediate gear 558 to be driven by the upper drive gear 556. The stepper motor may rotate the upper transfer gear 552 via the intermediate gear 558 in an anticlockwise to transport media items along the return transport path as shown in FIG. 4 (i.e., in an opposite direction to the infeed transport path) or in a clockwise direction to urge media items in an opposite direction to the return transport path to clear a media item jam on the return transport path for example.

However, when the upper transfer gear 552 moves between the upper and lower positions, the upper transfer gear 552 is disengaged from an intermediate gear 554 or 558 and in turn is decoupled from the upper drive gear 556. This in turn allows the transport belts 308, 312 of the respective upper transport members 303, 305 to rotate freely. Respective end regions of a bunch of media items 350 located across the first and second pairs of transport members 302, 304, 304, 305 are therefore unconstrained and free to move with a respective pair of transport belts along the transport path when the second pair of transport members 304, 305 moves with respect to the first pair of transport members 302, 303. As a result, the risk of a bunch of media items being damaged as a result of otherwise undesirable crumpling, creasing or stretching of the bunch of media items when the second pair of transport members is moved with respect to the first pair of transport members is at least reduced if not eliminated. For example, if the drive mechanism 550 was not disengaged from the respective upper and lower pairs of transport belts 308, 312 and 306, 310 when the second pair of transport members move with respect to the first pair of transport members, the end regions of the bunch 350 would be constrained in a direction along the transport path and forced together or apart which can cause crumpling or stretching of the bunch respectively.

The drive gear arrangement according to certain embodiments of the present invention therefore transfers a driving force from a stepper motor to a drive transfer gear to drive the respective belts of first and second pairs of transport members which in turn urges a bunch of media items along a predetermined transport path. The drive mechanism also allows for automatic disengagement of the drive transfer gear when the second pair of transport members moves from and between an infeed position to a return position, and vice versa. This in turn disengages the respective transport belts of the respective first and second pairs of transport members to allow at least one end region of the bunch of media items to move along the transport path and in turn prevents the bunch of media items from becoming damaged. In turn, the quality and integrity of the bunch of media items being processed is not compromised. For example, a customer may deposit a check at an SST, and due to an erroneous or unauthorized transaction, the check may be returned to the customer. In accordance with certain embodiments of the present invention, the check will be returned to the customer in the same condition as it was deposited by the customer.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. A method of transporting at least one media item along a transport path, comprising:

in a first mode of operation, applying an urging force, by a first transport member of an apparatus, to at least one media item to transport said media item at least partially along a transport path, and in the first mode of operation, coupling at least one drive member to a first belt of the first transport member and to a further belt of a further transport member to urge the at least one media item along the transport path when the first and further belts are rotated by said drive member; and in a further mode of operation, releasing the urging force on said media item to allow at least one end region of the media item to move freely along the transport path and in the further mode of operation, when said media item extends between the first and further belts, decoupling said drive member from the first and/or further belt whereby the first and/or further belt is free to rotate to allow the at least one end region of the media item to move freely along the transport path, and wherein the decoupling further includes automatically decoupling said drive member from the first and/or further belt responsive to a one of the first and further transport members moving with respect to a remainder one of the first and further transport members thereby preventing damage to a media item, and wherein the decoupling further includes moving the first transport member with respect to the further transport member between a first position and a further position about an axis substantially perpendicular to the at least one transport path, wherein a first end region of the first transport member is pivotally connected about the axis to a further end region of the further transport member and wherein at least one drive member comprises at least one drive gear, and the decoupling further comprising, responsive to the first transport member moving from the first position to the further position, moving the at least one drive gear from a first engaged position in which the at least one drive gear is engaged with at least one first driven gear coupled to the first and further belts, to a further engaged position in which the at least one drive gear is engaged with at least one further driven gear coupled to the first and further belts, and decoupling the at least one drive gear from the first and further belts when the drive gear moves between the first engaged position and the further engaged position.

2. The method as claimed in claim 1, via the first and further belts, urging the at least one media item in a first direction along the transport path when the first transport member is in the first position, and urging the media item in a further direction along the transport path when the first transport member is in the further position, said first direction being opposite to said further direction.

3. Apparatus for transporting at least one media item along a transport path, comprising:

a first transport member and a further transport member that selectively apply an urging force to at least one media item to urge said media item along a transport path; wherein in a first mode of operation, the urging force is applied to said media item to transport said media item at least partially along the transport path and, in a further mode of operation, the urging force on said media item is released to allow at least one end region of the media item to move freely along the transport path;

a first belt of the first transport member and a further belt of the further transport member that are selectively driven by at least one drive member, and in the first mode of operation, the at least one drive member is selectively coupled to the first and further belts to rotate the first and further belts and urge the at least one media item along the transport path and, in the further mode of operation, when said media item extends between the first and further belts, said drive member is decoupled from the first and/or further belts whereby the first and/or further belt is free to rotate to allow the at least one end region of the media item to move freely along the transport path, wherein the at least one drive member is automatically decoupled from the first and/or further belts responsive to a one of the first and further transport members moving with respect to a remainder one of the first and further transport members thereby preventing damage to a media item, wherein a first end region of the first transport member is pivotally connected to a further end region of the further transport member about an axis substantially perpendicular to the transport path, and the at least one drive member is decoupled from the first and/or further belt when the first transport member moves with respect to the further transport member about the axis between a first position and a further position, wherein the at least one drive member comprises at least one drive gear which, when the first transport member is in the first position, engages with at least one first driven gear coupled to the first and further belts and, when the first transport member is in the further position, engages with at least one further driven gear coupled to the first and further belts.

4. The apparatus as claimed in claim 3, wherein the first and further belts urge the at least one media item in a first direction along the transport path when the first transport member is in the first position and urge the media item in a further direction along the transport path when the first transport member is in the further position, said first direction being opposite to said further direction.

5. The apparatus as claimed in claim 3, further comprising:

a clutch member located between the at least one drive member and the first and further belts that selectively decouples the at least one drive member from the first and/or further belt responsive to the first transport member moving with respect to the further transport member.

6. A media item processing module comprising the apparatus as claimed in claim 3.

* * * * *